United States Patent [19]

Tannerstal

[11] 4,363,342

[45] Dec. 14, 1982

[54] LOG MILLING APPARATUS

[75] Inventor: Harding Tannerstal, Söderhamn, Sweden

[73] Assignee: Bruks Mekaniska AB, Arbra, Sweden

[21] Appl. No.: 157,036

[22] Filed: Jun. 6, 1980

[51] Int. Cl.[3] ..... B27C 9/00

[52] U.S. Cl. ..... 144/2 R; 144/208 F; 144/162 R; 407/59; 409/166; 144/377

[58] Field of Search ..... 409/166, 192, 197, 199, 409/200, 203; 407/7, 59; 142/1, 40, 48; 144/4, 136 H, 2 R, 3 R, 208 R, 236, 237, 323, 162 R, 176, 108 F, 208 J

[56] References Cited

U.S. PATENT DOCUMENTS 2,645,003 7/1953 Thompson et al. ..... 407/59
3,082,801 3/1963 Dillingham ..... 144/208 G
3,842,874 10/1974 Nonyuki et al. ..... 144/3 R
3,986,543 10/1976 Slayton et al. ..... 144/236

*Primary Examiner*—W. D. Bray
*Attorney, Agent, or Firm*—Zarley, McKee, Thomte, Voorhees & Sease

[57] ABSTRACT

In a milling apparatus for removing root swellings from timber logs the log is received on two spaced apart supports with the butt-end of the logs freely overhanging from the supports. A holder-on urges the log against the supports. The holder-on as well as the supports comprise means for rotating the log relative to the holder-on as well as the supports. Under the overhanging butt-end of the log a milling cutter cylinder is arranged for machining the rotating log on the bottom side of the log so as to remove the swellings but no useful wood material.

21 Claims, 6 Drawing Figures

LOG MILLING APPARATUS

This invention relates to a log milling apparatus and particularly to an improved apparatus for milling logs of the type which are gained from the lower part of the trees and thereafter sawn to form boards.

BACKGROUND OF THE INVENTION

The logs which after adaptation and cross cutting are gained from the lower part of a tree are named root logs. Such root logs present particular swellings or enlargements, so called root legs, at their lower portion connected to the root system of the living tree. When a root log is to be sawn for instance in a frame saw these swellings may cause troublesome problems. Thus it often happens that the swellings or parts thereof are thrown loose and smash saw blades, blocks and clamping means included in the saw frame. The consequence of such incidents will be stoppage with the ensuing economical loss. Even if damages on the saw frame itself would occur at times only the mere presence of the swellings brings about other considerable disadvantages. By the fact that the swellings may project rather marked outside the normal conicity or the normal mean diameter of the log at the root or butt end thereof the saw frame has to be designed with very large dimensions in order to be capable of receiving not only that portion of the thickest log which gives a yield in the form of boards but also the rimshaped portion jointly formed by the root swellings. This means that the saw frame becomes rather heavy, what in turn means that the frame can be driven with a rather limited speed only.

In order to eliminate the above mentioned disadvantages it is previously known to mill off the root swellings before sawing the log. One type of apparatus used for this purpose includes an annular or cylindrical rotatable tool which is provided with cutting members located on the inside of the tool body and through which the log is fed while being held by a feed assembly. This feed assembly supports the log at the opposite ends thereof and moves it in the length direction thereof throughsaid tool which is rotated in order to carry out the milling. Such apparatus is known for instance by the Swedish patent specification Nos. 363,755 and 386,852 as well as the Norwegian patent specification No. 129,668. Another apparatus for the same purpose is known by the German Offenlegungsschrift No. 2,813,159 which discloses a tool having its cutting members located on the outside of the tool body. Also in this case the log is fed past the tool by means of a feed assembly supporting the log at the opposite ends thereof, though in this case allowing rotation of the log relative to the tool. Common to these two types of log milling apparatus is however that the log portion machined by the tool is always cylindrical because the feed assemblies define a certain center line in the log and irrespective of whether the log is rotated or not the tool works in a circular path around this center line and leaves a finished log portion of cylindrical shape as the log passes the tool. Since timber logs are often at least slightly conical rather than cylindrical this means in practice that the yield achieved by the prior art apparatus is limited in so far as not only the swellings are removed from the logs but also the yieldable wood material defined by the difference between a conical and a cylindrical shape of the log portion machined.

Another disadvantage of the prior art apparatus is a relatively low production capacity.

SUMMARY OF THE INVENTION

It is a general object of the present invention to provide a log milling apparatus for removing the swellings occuring at the butt-ends of root logs, which apparatus guarantees a maximum yield from each log irrespective of the shape thereof while efficiently removing undesirable root swellings from the logs.

Another object of the invention resides in the provision of an apparatus having a high production capacity.

A further object is to provide an apparatus which is capable of receiving from a supply of unsorted logs, logs from which root swellings are to be milled off as well as logs having no root swellings and then rapidly discharge the latter logs from the apparatus.

These and other objects and advantages are achieved by a log milling apparatus comprising means for receiving and supporting a log with the swelled root end thereof overhanging therefrom, said receiving means having spaced apart first and second ends defining the length thereof, means for urging said log against said receiving means so as to hold said log in a firm grip resisting forces applied to said overhanging root end of said log, means for rotating said log about itself as well as relative to said receiving means and said urging means, and a cutter arranged beside said receiving means and on substantially the same side of said log as said receiving means so as to machine said overhanging swelled root end of said log along a line which is located in the extension of the length of said receiving means and on the same side of said log as said receiving means.

DETAILED DESCRIPTION OF THE PREFERRED EMBODIMENT

Figure 1:
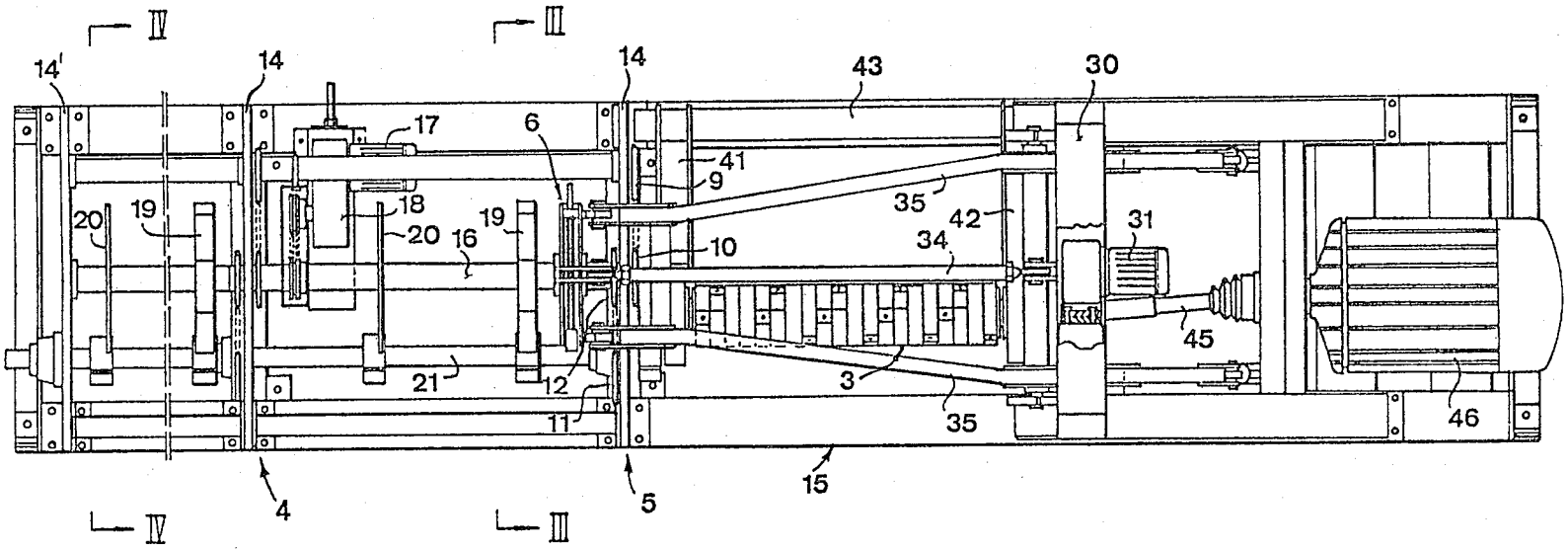
FIG. 1 is a horizontal view from above of the apparatus according to the invention, FIG. 2 a vertical elevational view of the same apparatus, FIG. 3 an enlarged transverse sectional view III—III of FIG. 1, FIG. 4 a transverse sectional view IV—IV of FIG. 1 likewise enlarged but cut off at the top, FIG. 5 a partially cut longitudinal sectional view of a cutter unit included in the apparatus, and FIG. 6 a transverse sectional view VI—VI of FIG. 5.
Figure 2:
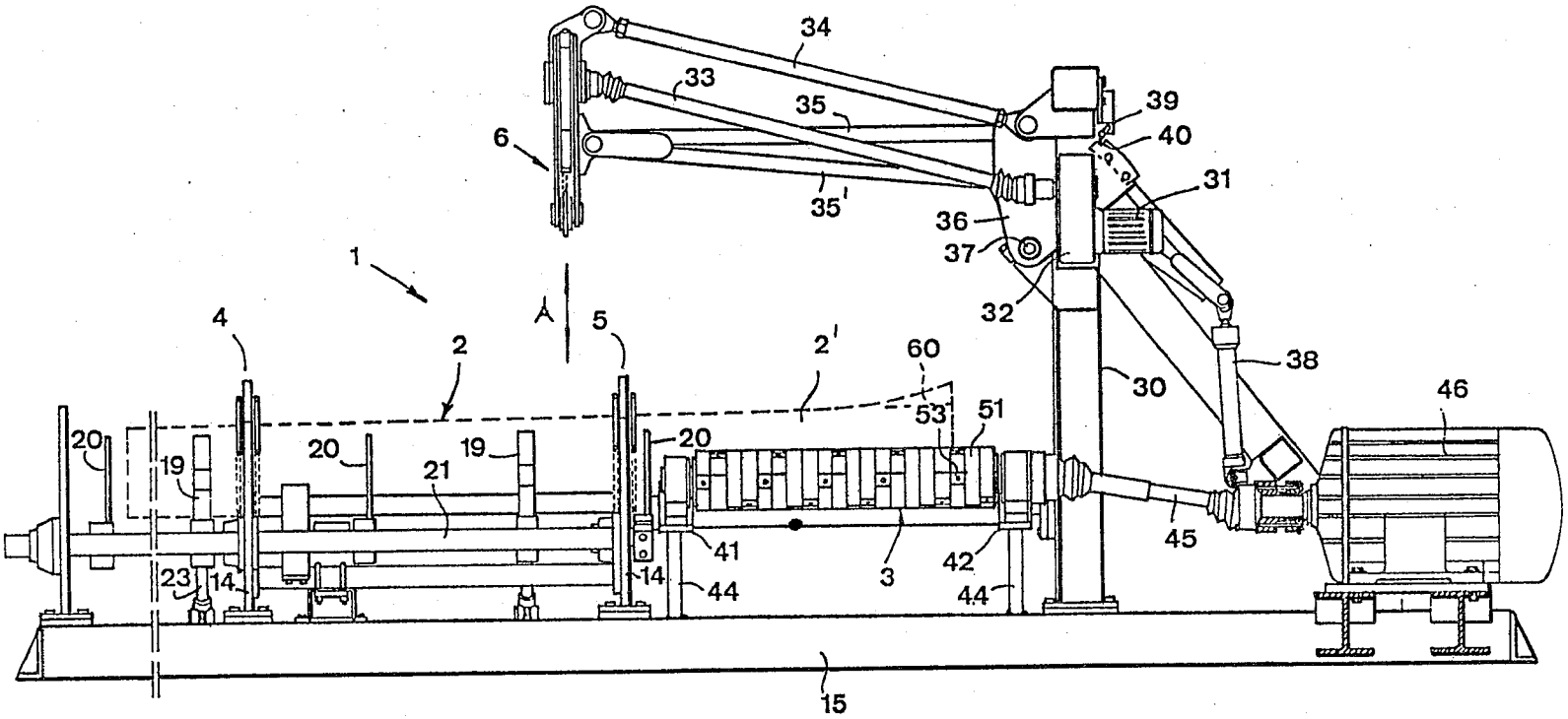

As appears from FIGS. 1 and 2 the apparatus of the invention comprises a receiving means generally designated 1 which has two functions, namely supporting a root log 2 and causing the same to rotate. A rotatable mill or cutter unit 3 provided with external working elements is movable towards and away from a log butt-end portion 2' which overhangs from the receiving means 1. The swellings or enlargements occuring on this butt-end of the log are indicated by the reference numeral 60.

The receiving means 1 comprises two spaced apart V-shaped supports 4 and 5 defining first and second ends of said receiving means. These V-shaped supports support the log from below. Above the supports there is an urging means in the shape of a holder-on 6 which is movable towards and away from said supports. This holder-on 6 is arranged to urge the log 2 against the supports in order to hold the logs in the position indicated with dashed lines in FIG. 2, the force applied to the log by the holder-on being great enough to resist forces applied to the overhanging root end 2' by the cutter unit 3. The holder-on 6 is movable in a substantially vertical plane located between the two supports 4 and 5 as indicated by the double arrow A in FIG. 2. It should be noted that the plane of movement of the holder-on is located at a distance not only from the first support 4 but also from the second support 5, though the latter distance is rather small.

Figure 3:
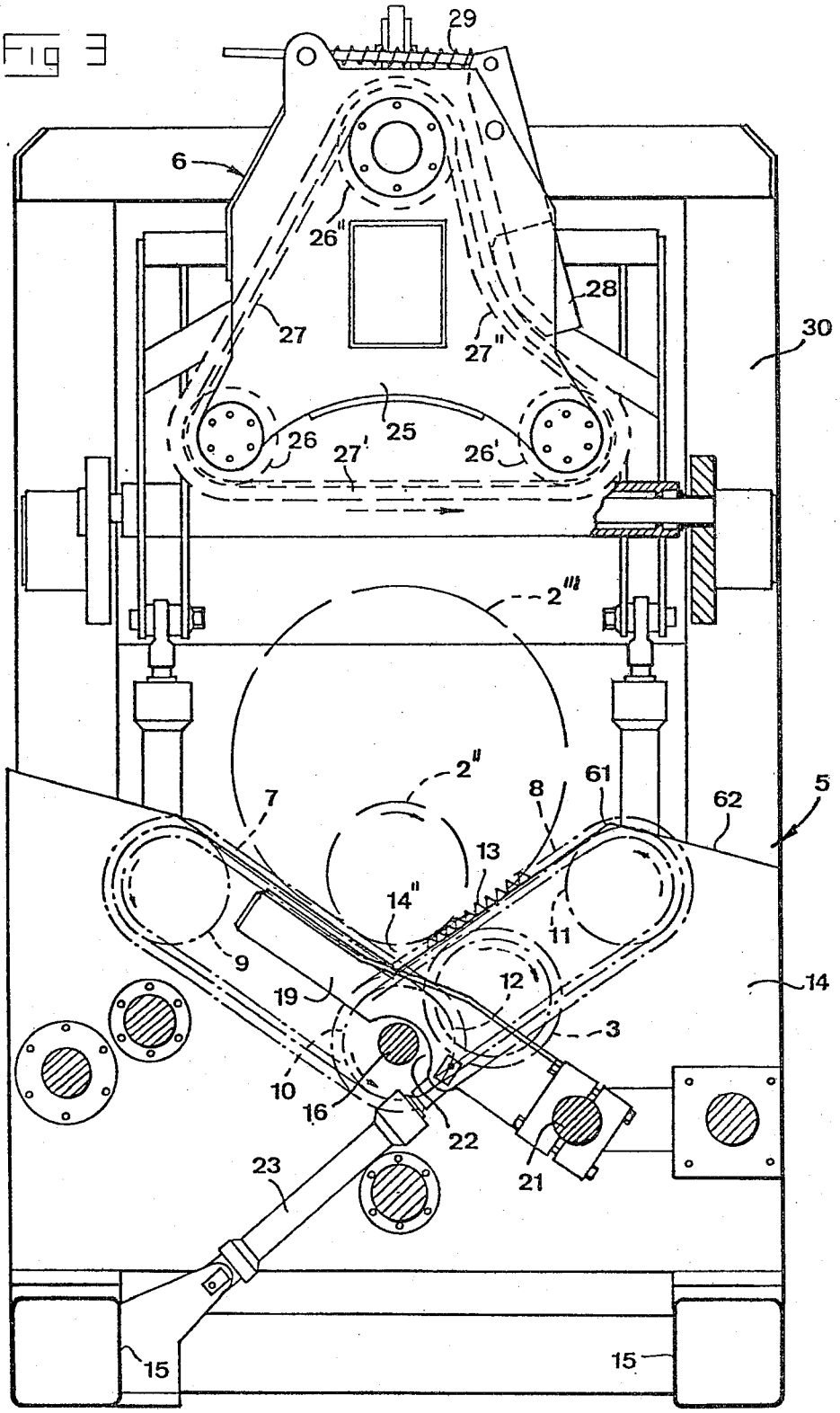

FIG. 3 illustrates that the support 5 (like the support 4) comprises two endless chains 7, 8 each extending between a pair of spaced apart sprocket wheels 9, 10 and 11, 12 respectively (see also FIGS. 1 and 2). Both of these chains may advantageously be provided with suitable dogs 13. The sprocket wheels 9, 10, 11 and 12 are supported by a vertical plate 14 which in turn is supported by a longitudinal foundation 15 included in the apparatus. One pair of sprocket wheels 9, 10 is located on one side of said plate 14, while the other pair of sprocket wheels 11, 12 is located on the opposite side of said plate. The two sprocket wheels 9 and 11 are displaced upwardly and outwardly in relation to the wheels 10 and 12 respectively so that the two upper parts of the chains 7 and 8 are inclined while forming a V-shaped configuration being suitable for receiving the log 2 which in FIG. 3 is shown by the two dash-lined circles 2'' and 2''' which indicate that the log may have a highly varying diameter. In the upper portion of each plate there is a V-shaped recess 14''.

The two sprocket wheels 10 and 12 at each support 4 and 5 are in this case fixed to a rotatable drive shaft 16 extending along the length of the receiving means, said shaft being arranged to jointly drive all of the chains 7, 8 in one and the same tangential direction of movement. More precisely the chains shown in FIG. 3 are arranged to be driven with their upper or receiving part moving rightward in the drawing. The shaft 16 is advantageously driven by an electric motor 17 through a gearing 18.

For removing the log 2 from the receiving means after machining the log or for removing such logs which have been fed into the machine but which should not be machined, there are provided a number of ejecting means 19, 20 spaced apart along the length of the receiving means, said ejecting means being pivotable between an inoperative position below the log and an operative position in which it is angularly displaced at least 90° relative to the inoperative position. The ejecting means 19 simply consist of arms which are fixed to a common rotatable shaft 21. The shape of the arms is such that in the inoperative position they are housed below the imaginary V-shaped channel which is constituted by the pairs of chains 7, 8, said arms having a recess 22 for housing the shaft 16 driving the chains. Just the two arms 19 are furthermore pivotally connected to piston-cylinder mechanisms 23 provided for carrying out the movement of the ejecting means from the inoperative position to the operative position. The means 20 in turn may advantageously consist of more or less simple plates which are designed with an arcuate circumferential part 24 which is concentric to the rotatable shaft 21. These arcuate parts 24 of each of said means 20 has the purpose of preventing unintentional charging or feeding in logs to the receiving means when the ejecting means are moved to their operative position.

The shaft 16 as well as the shaft 21 are advantageously mounted in bearings in the plates 14 of the supports 4 and 5. In the embodiment shown there is a further supporting plate 14' at that end of the receiving means which is remote from the cutter unit 3, said further supporting plate being arranged for mounting the ends of said two shafts.

As best illustrated in FIG. 3 the above mentioned holder-on 6 comprises a yoke 25 having three sprocket wheels 26, 26' and 26''. These sprocket wheels, which are triangularly located, jointly support an endless chain 27 which like the chains 7, 8 advantageously have suitable dogs. The chain 27 has a downwardly facing substantially horizontal part 27' arranged to be applied to the log 2. Another part 27'' is acted on by a resilient pivotable shoe 28 which always tends to stretch the lower part 27' and against the action of which the latter part is deflectable in order to be adapted to different sectional sizes of the log 2. The resilience of the shoe 28 is realized by means of spring means 29. The sprocket wheel 26' is rotatable in order to drive the chain 27 in the same tangential direction of movement as the chains 7, 8 of the supports 4, 5. As appears from FIG. 2 the rotation of said sprocket wheel 26'' is attended to by a motor 31 supported on a frame 30, said motor being connected to said sprocket wheel through a gear 32 and a universal driving shaft 33.

The yoke 25 is suspended at the free end of a guiding link system including a guiding link 34 as well as two separate control links 35 each being composed of two tubes or rods 35, 35'. These control links are connected to plate pieces 36 which are arranged on a common shaft 37 and pivotable by means of piston-cylinder mechanisms 38.

On top of the frame 30 there are a number of limit switches 39 which are placed close to each other, only one of said switches being visible in FIG. 2. Each of these limit switches has a corresponding stop 40 on the plate 36 (only one of said stops is visible in FIG. 2). Said stops 40 has the purpose of detecting the diameter of the log when the holder-on 6 is moved against the log 2 and, by means of said limit switches 39,actuating time relays which in turn determine the length of the milling time. Since the chains 7, 8 and 27 are driven with a constant speed the necessary milling time will vary depending on the size of the logs in such a way that a thicker log will necessitate a longer milling time than a slender log. This is automatically controlled by means of said switches, stops and time relays.

Of course the plate 36 may be provided with other means for detecting and/or indicating the lowering of the holder-on 6 and thereby the sectional sizes of the logs. Such means might also be utilized for instance in a marking and/or classification system in which the logs are classified depending on their sectional sizes.

The cutter unit 3 included in the apparatus has the form of a long cylinder which is supported between two spaced apart supporting arms 41, 42 directed at angles to the axis of rotation of the cutter unit (see FIG. 1). Said arms are mounted for rotation about a common shaft 43. By means of piston-cylinder mechanisms 44 (see FIG. 2) these supporting arms 41, 42 are pivotally movable from an inoperative position located below the log to an operative position in contact with the log or more precisely the butt-end of the log overhanging from the receiving means 4, 5. At the rightward end in FIG. 2 the milling cutter cylinder 3 is connected to one end of a universal driving shaft 45 which at its opposite end is connected to a stationary source of power 46, for instance an electric motor. As appears from FIG. 1 the axis of rotation of said milling cutter cylinder is substantially parallel to the length of the receiving means or the apparatus in its entirety and the cylinder in question is in practice driven in the same direction of rotation as the direction of rotation of the log, that is opposite to the direction of rotation of the sprocket wheels 9, 10, 11, 12. This is the case because the cutting or working elements of the milling cutter cylinder shall work in a direction which is opposite to the direction at movement of the circumferential portions of the log.

Figure 6:
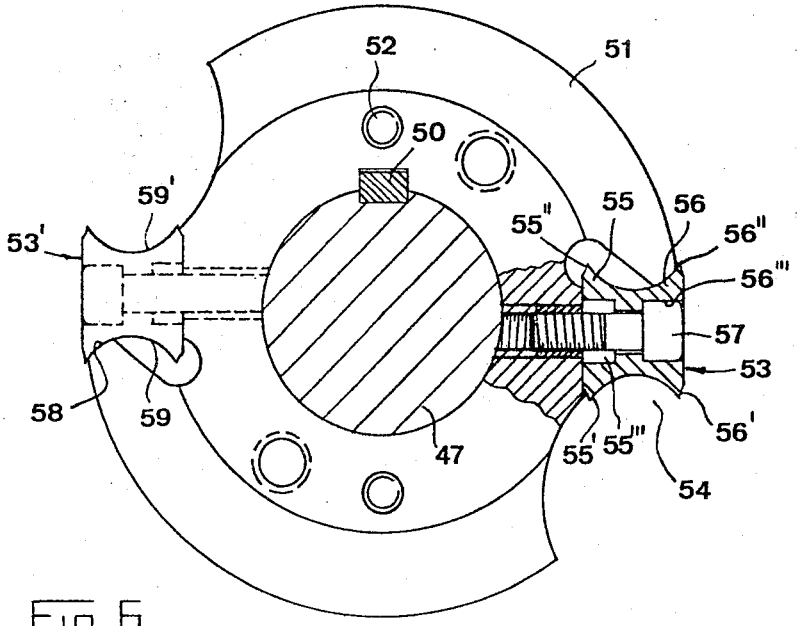
Figure 5:
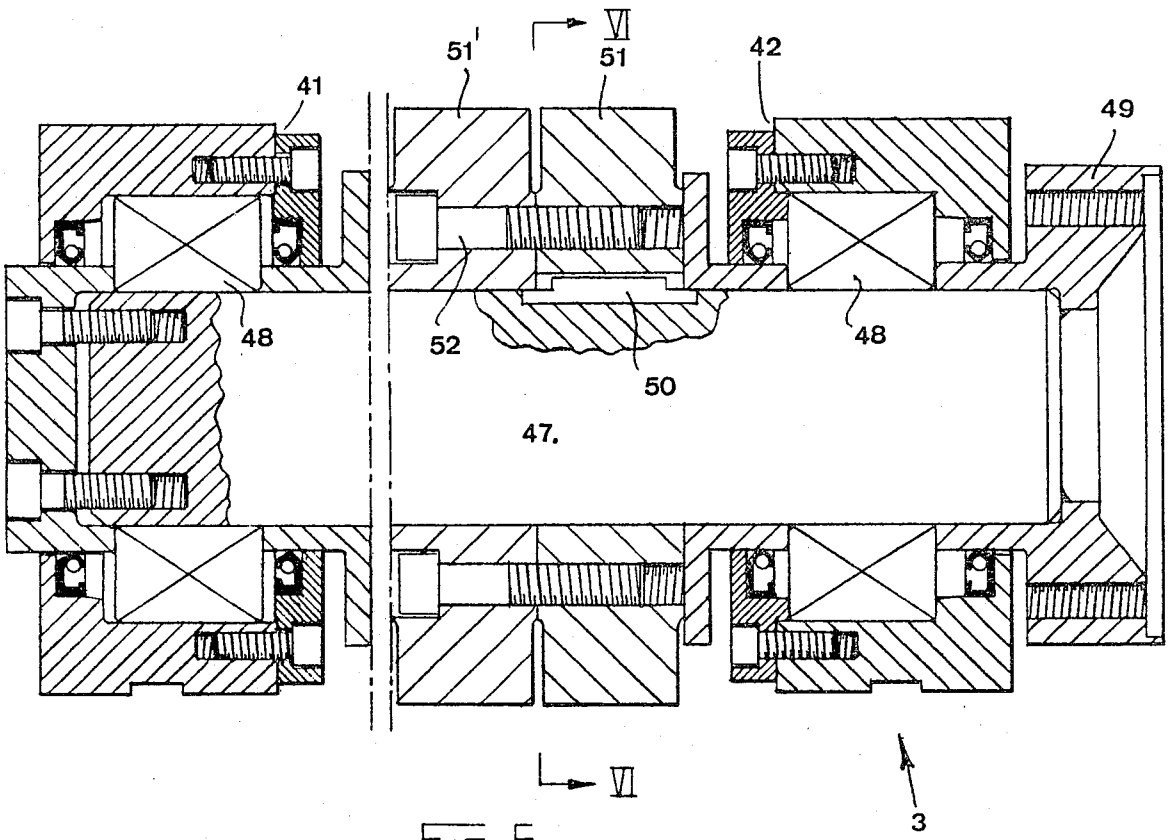

Now reference is made to FIGS. 5 and 6 which in detail illustrate the structure of the milling unit 3. As a central part said milling unit comprises a shaft 47 which is mounted in bearings 48 connected to the supported arms 41, 42 at the opposite ends thereof. At that end of the shaft which is directed towards the motor 46 the shaft is rigidly connected to a member 49 to which the driving shaft 45 is in turn connected.

A lamella or ring 51 is fixed to the shaft 47 by means of a key 50, said ring being included in a series of rings arranged side by side along the shaft. The ring 51 is connected to the adjacent ring 51' by means of bolts 52. As appears from FIG. 6 each ring 51 has two diametrically opposed cutting bodies 53, 53' provided in recesses 54 in the circumferential portion of the lamella ring. Each single cutting body 53 includes two identical halves 55 and 56 and each of these halves presents two opposite cutting portions or edge portions 55', 55'' and 56', 56'' respectively as well as at least one countersink 55''' and 56''' respectively for a fastening member in the shape of a headed bolt 57 by means of which the cutting body may be fixed to the lamella ring. Those portions of the lamella ring which confine each recess 54 has a convexly rounded supporting surface 58 which has its counter part in the cutting body in two correspondingly rounded concave abutting surfaces 59, 59'.

The advantage of the cutting bodies designed in the above mentioned way is that they have four edges which can be used as they are worn, because they may be shifted between four different positions by the adjustment of the cutting bodies. When all four edges has been worn the cutting body may be discarded and substituted for a new one.

As indicated in FIGS. 1 and 2 the various lamella rings 51, 51' etc. are displaced relative to each other in such a way that the cutting bodies or working elements 53, 53' jointly form screwshaped configurations along the envelopesurface of the milling unit.

The apparatus described operates in the following way when machining a log having root swellings of the type previously mentioned.

Figure 4:
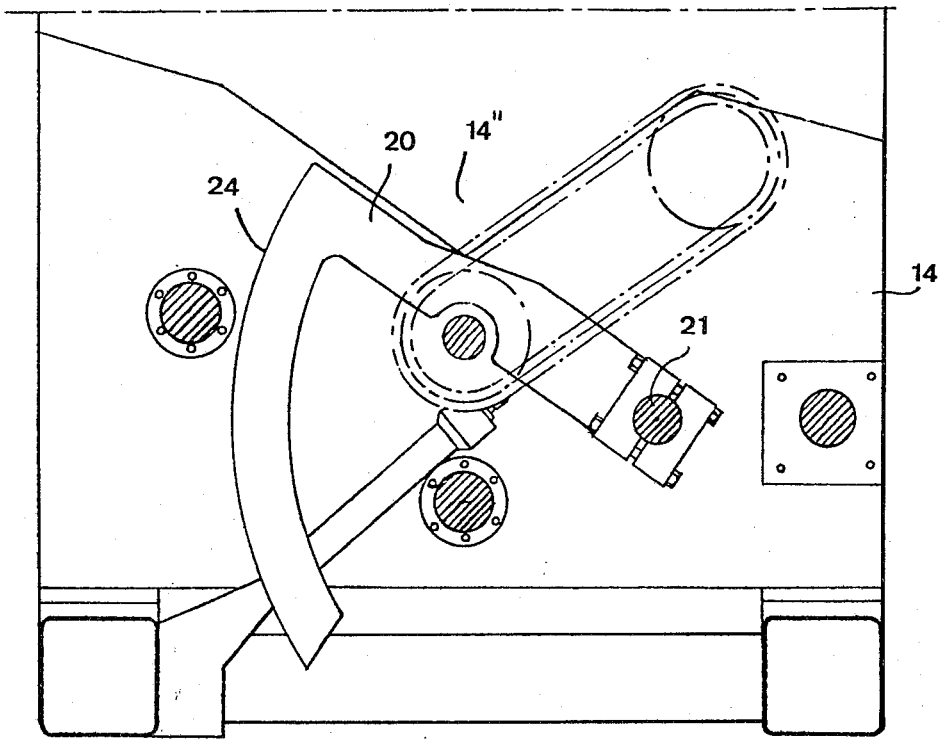

Initially the holder-on 6 is raised to its inoperative position shown in FIGS. 2 and 3. The milling cutter unit 3 is likewise located in its inoperative position located a certain distance below an imaginary extension of the V-shaped channel constituted by the recesses 14'' in the supports 4, 5. Also the ejecting means 19, 20 are in their inoperative position (see FIGS. 3 and 4).

A log 2 the swellings 60 of which shall be removed is rolled onto the receiving means in the form of the supports 4, 5 from a table (not shown) placed next to said receiving means so that the log will rest in the V-shaped recesses in the supporting plates 14 with the chains 7, 8 of both supporting plates in engagement with the periphery of the log. It should be noted that the log when being conveyed to the receiving means 4, 5 is located with the butt end freely projecting or overhanging from the support 5. It should also be noted that the log 2 often may be of conical shape and when (like in the case of a cylindrical log) a generatrix line along the bottom portion of the log received is located in a substantially horizontal plane, i.e. parallel to the axis of rotation of the milling cutter unit 3. In the next step the holder-on 6 is lowered towards the log so that the bottom part 27' of the chain 27 contacts the log with at least a certain portion of said part being adapted to the sectional shape of the log. The log is now held in a firm grip resisting the forces which will be applied to the overhanging free end of the log by unit 3. Rotation of the log now held by the holder-on 6 and the supports is carried out by driving the sprocket wheel 26'' and the shaft 16, meaning that the chains 7, 8 and 27 are moved while rotating the log.

In order to cut off the swellings 60 from the log the milling cutter unit 3 is pivoted to its operative position in which it contacts said swellings while at the same time rotating the unit about its axis by means of the motor 46. In practice the milling cutter unit 3 is rotated at a speed in the range of 500 to 1,000 RPM, while the log is rotated just one single revolution. This may be accomplished within 5 to 10 seconds depending on the diameter of the log.

As the milling operation has been finished the milling cutter unit is lowered to its inoperative position and the holder-on 6 is removed from the log by means of the piston-cylinder mechanisms 38. After that the log is ejected from the receiving means 4, 5 by means of the ejecting means 19, 20 previously described said ejecting means being pivoted approximately 90° from the inoperative position to a position in which they pass a ridge 61 on the plates 14. When the log 2 passes this ridge 61 it may automatically roll out from the apparatus by means of the slanting portions 62 of the plates 14. When the ejecting means have been returned to the inoperative position the apparatus is ready to receive another log for machining.

When assuming its operative position as illustrated in FIG. 3 the milling cutter unit 3 is located with its center axis not vertically below the imaginary center axis of the log (or the receiver length axis defined by a straight line between the bottoms of the V-shaped recesses 14'' in the plates 14) but laterally displaced a short distance from the vertical plane through said log axis. This is the case because in the embodiment shown the milling cutter unit is always moved to a certain fixed operative position, i.e. to one and the same level irrespective of the diameter of the log. If the cylinder were located exactly below the log axis more useful material would be cut off from a slender log than from a thicker one since a slender log would rest deeper in the V-shaped recesses of the supports than a thicker one. By locating the cylinder slightly displaced as shown in FIG. 3 a compromise is achieved according to which substantially no useful wood material will be removed from slender logs. Of course this result would also be achieved by locating the cylinder vertically under the log axis while at the same time providing the piston-cylinder mechanisms 44 for the unit 3 with control means which raises the unit 3 to different levels depending on the diameter of each individual log.

An important feature of the apparatus described is the fact that the log end portion to be machined is freely overhanging from a receiving means which supports the log from below at the same time as the milling cutter unit used is located in such a way that it too contacts the log substantially from below (i.e. from the same side of the log as the receiving means). This means that just the undesired swellings of the log will be removed while substantially all useful wood material will be left even if the log is of extreme conical shape or if the cross sectional shape thereof is irregular. Of course the apparatus may be utilized for machining all types of logs independent of the diameter or cross sectional sizes thereof.

POSSIBLE MODIFICATIONS

The invention is not limited merely to the embodiment described and illustrated in the drawings. Instead of a receiving means composed of precisely two spaced apart supports of the art described it is thus conceivable to use other types of receiving means, for instance receiving means comprising an appropriate number of wheels and or cylinders. Instead of just one holder-on two or more such members may be used.

What is claimed is:

1. A log milling apparatus comprising, means for receiving a log and supporting the same from below with the swelled root end thereof overhanging therefrom, said receiving means having spaced apart first and second ends defining the length thereof, means for rotating said log relative to said receiving means, and a milling cutter arranged beside said receiving means and under said overhanging root end of said log so as to machine said overhanging swelled root end of said log from below and along a line which is located in the extension of the length of said receiving means.

2. A log milling apparatus as claimed in claim 1, comprising means for urging said log against said receiving means.

3. A log milling apparatus as claimed in claim 1, wherein said receiving means comprises two spaced-apart supports defining said first and second ends of said receiving means.

4. A log milling apparatus as claimed in claim 2, wherein said milling cutter is movable towards and away from the bottom portion of said overhanging root end of said log.

5. A log milling apparatus as claimed in claim 3 or claim 2, wherein said urging means is located above and somewhere between said spaced-apart supports.

6. A log milling apparatus as claimed in claim 1, wherein said means for rotating said log is an integral part of said receiving means.

7. A log milling apparatus as claimed in claim 2, wherein said means for rotating said log is an integral part of said urging means.

8. A log milling apparatus as claimed in claim 3, wherein each support comprises two endless chains each of which extends between a pair of spaced apart sprocket wheels a first one of which is displaced upwardly and outwardly relative to the second one while making a log engaging part of each chain inclined relative to the horizontal plane, said two chains together forming a V-shaped configuration for receiving said log.

9. A log milling apparatus as claimed in claim 8, wherein said second sprocket wheels of said supports are fixed to a common rotatable shaft extending along the length of said receiving means, said shaft driving all log engaging parts of said chains in one and the same tangential direction of motion.

10. A log milling apparatus as claimed in claim 1, comprising a plurality of ejecting means spaced apart along the length of said receiving means for removing each log from said receiving means after finishing the machining thereof, said ejecting means being movable between an inoperative position underneath said log and a raised operative position in which said log is ejected from said receiving means.

11. A log milling apparatus as claimed in claim 10, wherein said ejecting means are fixed to a common rotatable shaft and pivotable between said inoperative and said operative position by means of said shaft.

12. A log milling apparatus as claimed in claim 10, wherein at least certain of said ejecting means include arcuate members for preventing unintentional charging of logs to said receiving means when said ejecting means are moved to their operative positions.

13. A log milling apparatus as claimed in claim 2, wherein said urging means includes a yoke having at least three sprocket wheels carrying an endless chain which has a substantially horizontal bottom part for engaging said log as well as at least one part being acted on by a spring-loaded shoe which tends to stretch said bottom part and against the action of which the latter part is deflectable in order to be adapted to various sectional sizes of the log.

14. A log milling apparatus as claimed in claim 2, wherein said urging means is suspended at the free end of a guiding link system the control links of which are connected to means for detecting the level of said urging means and thereby the sectional sizes of the logs.

15. A log milling apparatus as claimed in claim 1, wherein said milling cutter comprises a cylindrical body having working elements arranged on the envelope surface thereof.

16. A log milling apparatus as claimed in claim 15, wherein said milling cutter is composed of a plurality of lamellas each carrying one or more working elements, the working elements in adjacent lamellas being angularly displaced relative to each other in order to form a screw-shaped configuration along the envelope surface of said cylindrical cutter body.

17. A log milling apparatus as claimed in claim 15, wherein each working element comprises two identical halves, each having two opposite edge portions as well as a countersink for a mounting bolt.

18. A log milling apparatus as claimed in claim 17, wherein said working element is arranged in a recess in the periphery of said lamella, said recess having a curved convex support surface for said element which in turn has two correspondingly curved, concave abutting surfaces.

19. A log milling apparatus comprising means for receiving and supporting a log, said receiving means having spaced apart first and second ends defining the length thereof, means for urging said log against said receiving means, means for rotating said log relative to said receiving means and said urging means, and a milling cutter for machining said log, said urging means including a yoke having at least three sprocket wheels carrying an endless chain which has a substantially horizontal bottom part for engaging said log as well as at least one part being acted on by a spring-loaded shoe which tends to stretch said bottom part and against the action of which the latter part is deflectable in order to be adapted to various sectional sizes of the log.

20. A log milling apparatus comprising means for receiving and supporting a log, said receiving means having spaced apart first and second ends defining the length thereof, means for urging said log against said receiving means, means for rotating said log relative to said receiving means and said urging means, and a milling cutter for machining said log, said urging means being suspended at the free end of a guiding link system the control links of which are connected to means for detecting the level of said urging means and thereby the sectional sizes of the logs.

21. A log milling apparatus comprising means for receiving and supporting a log, said receiving means having spaced apart first and second ends defining the length thereof, means for rotating said log relative to said receiving means, and a milling cutter for machining said log, said milling cutter comprising a cylindrical body having working elements arranged on the envelope surface thereof, each working element comprising two identical halves, each having two opposite edge portions as well as a countersink for a mounting bolt, and being arranged in a recess in the envelope surface of said cutter, said recess having a curved convex support surface for said element which in turn has two correspondingly curved, concave abutting surfaces.

* * * * *